US009309820B2

(12) United States Patent
Wolff et al.

(10) Patent No.: US 9,309,820 B2
(45) Date of Patent: Apr. 12, 2016

(54) DEVICE FOR METERING FUEL

(71) Applicant: Robert Bosch GmbH, Stuttgart (DE)

(72) Inventors: Guenter Wolff, Schwieberdingen (DE); Ulrich Fischer, Ditzingen (DE); Martin Scheffel, Vaihingen (DE); Wilhelm Reinhardt, Oetisheim (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/405,655

(22) PCT Filed: May 24, 2013

(86) PCT No.: PCT/EP2013/060755
§ 371 (c)(1),
(2) Date: Dec. 4, 2014

(87) PCT Pub. No.: WO2013/182437
PCT Pub. Date: Dec. 12, 2013

(65) Prior Publication Data

US 2015/0152799 A1 Jun. 4, 2015

(30) Foreign Application Priority Data

Jun. 4, 2012 (DE) ..... 10 2012 209 421

(51) Int. Cl.
*F02M 61/14* (2006.01)
*F02M 55/02* (2006.01)
(Continued)

(52) U.S. Cl.
CPC ..... *F02D 33/003* (2013.01); *F02M 55/025* (2013.01); *F02M 61/14* (2013.01);
(Continued)

(58) Field of Classification Search
CPC ... F02M 55/025; F02M 61/14; F02M 61/168; F02M 69/465; F02M 2200/16; F02M 2200/803; F02M 2200/856; F02D 33/003; Y10T 137/87965
USPC ..... 251/148; 123/456, 470, 468–469
See application file for complete search history.

(56) References Cited

U.S. PATENT DOCUMENTS 4,294,215 A * 10/1981 Hans ..... F02D 41/3005 123/469
5,074,269 A * 12/1991 Herbon ..... F02M 55/004 123/456

(Continued)

FOREIGN PATENT DOCUMENTS

DE 102006017900 10/2007
DE 19758817 8/2010

(Continued)

OTHER PUBLICATIONS

International Search Report for PCT/EP2013/060755, issued on Aug. 1, 2013.

*Primary Examiner* — Mary McManmon
*Assistant Examiner* — David Colon Morales
(74) *Attorney, Agent, or Firm* — Kenyon & Kenyon LLP

(57) ABSTRACT

A device is described for metering fuel in internal combustion engines is provided, which includes a fuel distributor provided with a flow channel and at least one discharge orifice connected thereto, a valve which is connected to the fuel distributor for metering the fuel and has a pipe connection that is able to be attached to the discharge orifice, and connection means, which connects the fuel distributor and the valve to each other in the attachment region of the pipe connection and the discharge orifice in a pressure-tight manner.

9 Claims, 2 Drawing Sheets

(51) Int. Cl.
*F02D 33/00* (2006.01)
*F02M 61/16* (2006.01)
*F02M 69/46* (2006.01)

(52) U.S. Cl.
CPC ..... *F02M 61/168* (2013.01); *F02M 69/465* (2013.01); *F02M 2200/16* (2013.01); *F02M 2200/803* (2013.01); *F02M 2200/856* (2013.01)

(56) References Cited

U.S. PATENT DOCUMENTS 5,667,255 A * 9/1997 Kato ..... F02M 55/005 285/133.4
6,148,797 A * 11/2000 Gmelin ..... F02M 55/025 123/456
6,257,509 B1 * 7/2001 Hafner ..... F02M 51/005 239/585.1
6,318,341 B1 * 11/2001 Gmelin ..... F02M 55/02 123/456
6,640,784 B1 * 11/2003 Sims, Jr. ..... F02M 55/025 123/456
7,137,652 B2 * 11/2006 Kondo ..... F02M 55/005 123/456
7,406,946 B1 * 8/2008 Watanabe ..... F02M 55/005 123/456
7,516,735 B1 * 4/2009 Doherty ..... F02M 55/005 123/468
7,765,984 B2 * 8/2010 Fuerst ..... F02M 55/025 123/456
7,802,559 B2 * 9/2010 Furst ..... F02M 61/14 123/470
7,823,564 B2 * 11/2010 Edoardo ..... F02M 55/005 123/456
7,874,282 B2 * 1/2011 Ghelardi ..... F02M 55/005 123/456
2007/0006848 A1 * 1/2007 Ricco ..... F02M 55/025 123/456
2010/0154746 A1 * 6/2010 Fischer ..... F02M 61/14 123/456
2010/0258085 A1 * 10/2010 Giorgetti ..... F02M 55/02 123/470

FOREIGN PATENT DOCUMENTS

EP 2246555 11/2010
WO WO2006/092427 9/2006

* cited by examiner

DEVICE FOR METERING FUEL

FIELD OF THE INVENTION

The present invention is based on a device for metering fuel in internal combustion engines according to the definition of the species in claim 1. In this case, fuel describes a fluid, i.e., a liquid or gaseous fuel, whose chemical energy is transformed into a driving force through a combustion in an internal combustion engine, such as an Otto engine, a Diesel engine or a gas engine.

BACKGROUND INFORMATION

In one known device for fuel injection in internal combustion engines (German Patent No. 197 58 817 B4), a connection cup, which encloses the connection opening, is premolded on the fuel distributor, and an intermediate sleeve having an intake section is inserted into the connection cup and sealed from the cup wall with the aid of an O-ring. The intermediate sleeve is fixed in place on the fuel distributor by a securing element that engages with the intermediate sleeve and the connection cup in a form-fitting manner Via its pipe connection, the valve for metering the fuel is inserted into a widened section of the intermediate sleeve and sealed from the sleeve wall by an O-ring. A separate spring mount, between which a pressure spring is braced, is formed on the fuel distributor and the valve. After the valve has been inserted into a cylinder head bore in the cylinder head of the internal combustion engine and after the fuel distributor is secured on the cylinder head, the pressure spring, which is tensioned during the assembly, retains the valve with force-locking inside the cylinder bore.

SUMMARY

The device according to the present invention has the advantage of producing a seal between the valve and fuel distributor in the attachment region of the pipe connection and upstream flow opening, which seals in a reliable manner even at extremely high pressures and has a long service life. By positioning the flange element, which generates the contact pressure between the connection head and seat surface at the discharge opening, in the receiving element fixed in place on the valve, the at least one clamping bolt secured on the fuel distributor is able to "blindly" find the threaded hole during the assembly, so that the assembly can be simplified and automated. Optionally, a preassembly of the valves and the fuel distributor, or an installation of the fuel distributor on the valves already in place in the cylinder head of the internal combustion engine is able to take place. Once the fuel distributor and the valves are assembled, the flange element secured on the fuel distributor by the at least one clamping bolt clamps the connection head to the seat surface at the fuel distributor, so that the receiving head is unstressed. As a result, the receiving element will not have to satisfy special conditions in terms of stability.

According to one advantageous embodiment of the present invention, the flange element is a flat part and the receiving element has at least one bearing surface for the flat flange element and multiple detent hooks that overlap the flange element. Each detent hook has an integrally premolded hook strip, which axially projects from the at least one bearing surface, as well as a detent, which projects inwardly from the hook strip and overlaps the flange element on the side facing away from the bearing surface. The detent hooks not only fixate the flange element on the valve but also allow an axial tolerance compensation between flange element and undercut at the connection head once the fuel distributor and valve are assembled.

According to one advantageous specific embodiment of the present invention, a keyed connection that positions the flange element exists between the hook strips and the flange element. This keyed connection ensures the positionally precise alignment of the at least one threaded hole in the flange element in relation to the at least one clamping bolt on the fuel distributor.

Valves for metering fuel typically have a valve housing, which is sealed by a connector piece that is inserted into the valve housing at the extremity and integrally connected thereto. The connector piece has an intake bore, which connects the pipe connection to a fluid duct provided inside the valve housing, which in turn discharges into a valve chamber upstream from a metering orifice of the valve. In a first version, the pipe connection is inserted as a separate component into a blind hole in the connector and fixed in place by a plastic extrusion coat on the connector and the valve housing. In a second version of the valve, the pipe connection is integrally formed with the connector.

In one specific embodiment of the present invention that is adapted to the first version of the valve, the flange element is developed in mirror symmetry with the valve axis and has a central through hole for the pipe connection, and two diametrically positioned threaded holes; a pressure surface which engages with the undercut of the connection head is formed in the through hole. The flange element is already taken into account during the valve assembly and slipped over the pipe connection before the pipe connection is inserted into the connector and fixed in place on the connector and the valve housing by the plastic extrusion coat. During the extrusion coating, the receiving element is extruded at the same time.

In one specific embodiment of the present invention, which is adapted to the second version of the valve, the flange element is developed in the shape of a fork which has two fork arms that reach over the pipe connection and include a contact surface that engages with the undercut of the connection head in each case, and a fork back, which connects the fork arms to each other and has a machined threaded hole. The receiving element is provided with three separate seat surfaces, for the fork back and one end each of the two fork arms, as well as three detent hooks, one of which overlaps the fork back and an end of the two fork arms in each case. In this constructive development, it is possible to place the flange element on top of the pipe connection in the finished valve retroactively, prior to producing the receiving element with the aid of the plastic extrusion coating. In addition, it is also possible to lock or clip the flange element into place in the receiving element produced by the plastic extrusion coating on the finished valve.

According to one advantageous specific embodiment of the present invention, the seat surface at the valve opening and the head surface at the connection head are made of metal. Such a metal-to-metal connection requiring a high contact pressure between connection head and seat surface makes it possible to reduce the hydrocarbon emissions in the exhaust gas. The high contact pressure is produced by means of at least one clamping bolt.

DETAILED DESCRIPTION

Figure 1:
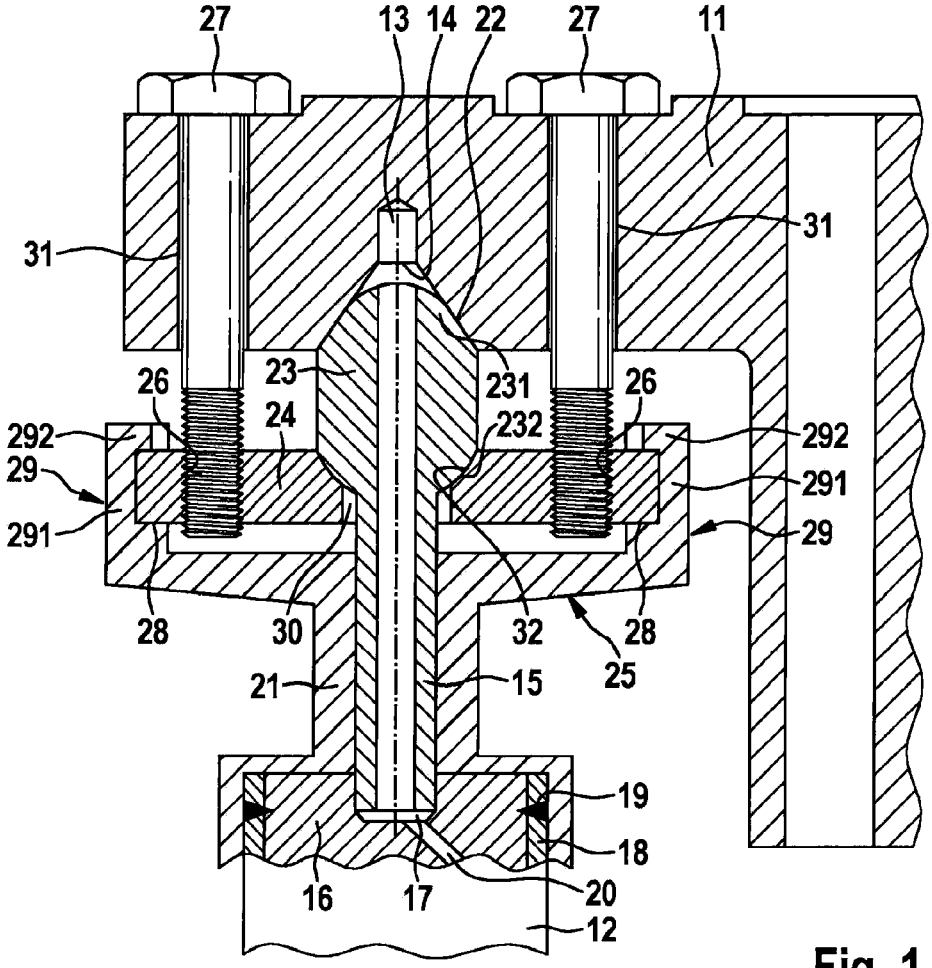
FIG. 1 a device for metering fluid, depicted in a cutaway view.

The device for metering fluid, shown in the form of a cutaway view as a longitudinal section in FIG. 1, for example, is used for the injection of fuel into the combustion chamber of an internal combustion engine. The fuel is under a very high system pressure. The device includes a fuel distributor 11 and a valve 12 for metering the fuel, which is connected to a fuel distributor 11. Fuel distributor 11 has a flow channel 13 and at least one discharge orifice, 14 which is in connection with flow channel 13. As a rule, a plurality of discharge orifices 14 are provided for multiple valves 12, but for reasons of clarity only a single discharge orifice 14 is shown in FIG. 1.

Valve 12 has a pipe connection 15 to connect valve 12 to discharge orifice 14. Pipe connection 15 is form-fittingly inserted into a blind hole 17 formed in a connector 16. Connector 16 seals a valve housing 18 at an extremity in a fluid-tight manner and is integrally connected to valve housing 18, in this instance, by a sketched welding seam 19. Connector 16 has an intake bore 20, which connects blind hole 17 to a fuel duct which extends inside valve housing 18, but is not shown here. The fuel duct in turn discharges into a valve chamber upstream from a metering orifice of valve 12. Pipe connection 15 is fixed in place on connector 16 and on valve housing 18 by means of a plastic extrusion coat 21.

To connect the valve(s) 12 to fuel distributor 11, connection means are assigned to each valve 12, which connect fuel distributor 11 and valve 12 to each other in the attachment region of pipe connection 15 and discharge orifice 14 in a pressure-tight manner. The connection means includes a seat surface 22 surrounding discharge orifice 14, a connection head 23, which is integrally formed on pipe connection 15, a flange element 24, and a receiving element 25 for flange element 24. Connection head 23 has a head area 231 facing seat surface 22, and an undercut 232 facing away from head area 231. Flange element 24 engages with undercut 232 and has at least one threaded hole 26 for a clamping bolt 27 fixed in place on fuel distributor 11. Flange element 24, which is developed as a flat part, is accommodated in receiving element 25 and lies inside receiving element 25 in a keyed connection, threaded hole 26 being correctly positioned with respect to clamping bolt 27. To achieve this, receiving element 25 has at least one bearing surface 28 for flange element 24 and a plurality of detent hooks 29 which overlap flange element 24. Each detent hook 29 has a hook strip 291 that axially projects from bearing surface 28, and a detent 292 that projects in a radially inward direction from hook strip 291, which overlaps flange element 24 on the side facing away from bearing surface 28. Receiving element 25 having bearing surfaces 28 and detent hooks 29 is extruded using plastic, concurrently with the production of plastic extrusion coat 21 on pipe connection 15.

Figure 2:
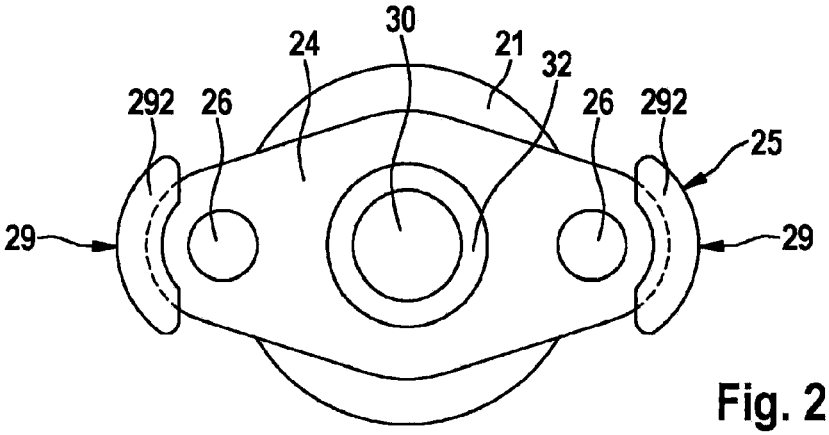
FIG. 2 a plan view of a flange element, accommodated in a receiving element, in the device according to FIG. 1.

In the exemplary embodiment of FIGS. 1 and 2, flange element 24 is developed in mirror symmetry with the valve axis and has a central through hole 30 for pipe connection 15, as well as two diametrically disposed threaded holes 26. A pressure surface 32 developed in through hole 30 is used to place flange element 24 against undercut 232 on connection head 23. A separate clamping bolt 27 is threaded through a through hole 31 in fuel distributor 11 and bolted inside one of threaded holes 26 in each case. Because of the screw joint, flange element 24 presses head surface 231 of connection head 23 onto seat surface 22 at discharge orifice 14 via pressure surface 32 and undercut 232, and thereby creates a metal-to-metal seal that satisfies the high tightness specifications at high system pressures of the fuel by way of the high clamping forces applied by clamping bolts 27. Seat surface 22 has a conical form, and head surface 231 of connection head 23 has a spherical form. Because flange element 24 is positioned inside receiving element 25 in a keyed connection, clamping bolts 27 "blindly" find threaded holes 26 during the assembly, so that the installation process is simplified and may be carried out in an automated manner.

Figure 3:
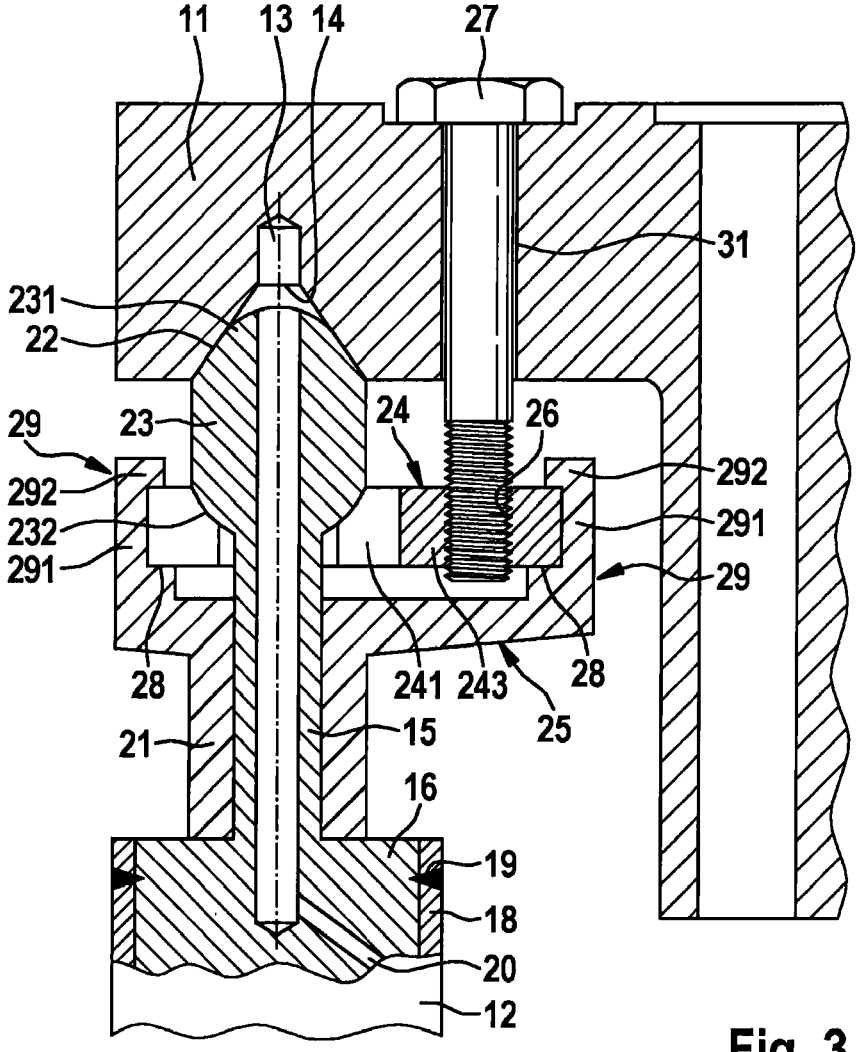
FIG. 3 a longitudinal section of the device according to a second specific embodiment, in a cutaway view.
Figure 4:
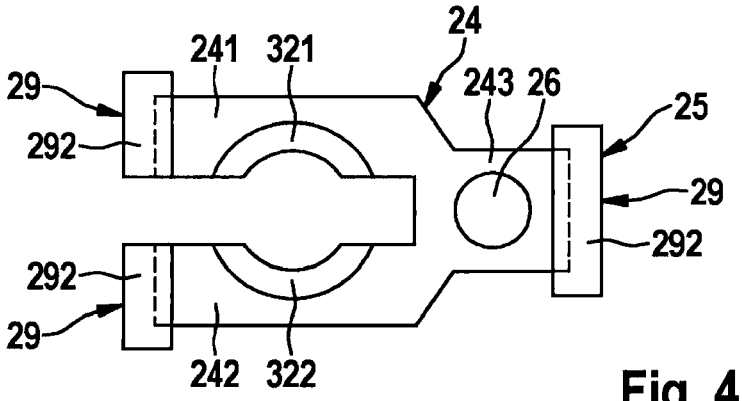
FIG. 4 a plan view of a flange element, situated inside a receiving element, in the device according to FIG. 3.

In the exemplary embodiment of the device shown in FIGS. 3 and 4, flange element 24 has been modified in comparison with the embodiment described previously. The remaining components are similar to those in FIG. 1 and therefore are designated by the same reference numerals. Flange element 24, which is once again developed as a flat part, has a fork-shaped design and is provided with two fork arms 241, 242 which enclose pipe connection 15, as well as a fork back 243, which interconnects fork arms 241, 242. A pressure surface 321 and 322, respectively, which corresponds to undercut 232 on connection head 23, is formed in each fork arm 241, 242, and threaded hole 26 for clamping bolt 27 has been produced in fork back 243. Receiving element 23 has three bearing surfaces 28, for fork back 243, for the one end of fork arm 241 and for the other end of fork arm 242, as well as three detent hooks 29, which are embodied in the same way as in FIGS. 1 and 3. Here, too, hook strips 291 of the three detent hooks 29 axially project from a bearing surface 28 in each case, and detents 292, which radially project from hook strips 291 in the inward direction overlap flange element 24 along the edge, one detent 292 overlapping fork back 243, one detent 292 overlapping the end of fork arm 242, and one detent 292 overlapping the end of fork arm 241. Receiving element 25 having bearing surfaces 28 and detent hooks 29 is extruded in one piece on pipe connection 15 during plastic extrusion coating 21. Flange element 24 is retroactively latched into receiving element 23, or is inserted into the injection mold when plastic extrusion coat 21 is produced. Pipe connection 15 is integrally formed with connector 16, so that valve 12 including pipe connection 15 is already completely assembled when plastic extrusion coat 21 is produced.

What is claimed is:

1. A device for metering a fuel in an internal combustion engine, comprising:

a fuel distributor having a flow channel and at least one upstream discharge orifice connected to the flow channel;

at least one valve for metering the fuel, the valve being connected to the fuel distributor and including a pipe connection for attachment to the discharge orifice; and a connection arrangement, wherein:

the connection arrangement connects the fuel distributor and the valve to each other in an attachment region of the pipe connection and the discharge orifice in a pressure-tight manner, and the connection arrangement includes:

a seat surface enclosing the discharge orifice, a connection head formed on the pipe connection and including a head area that comes to rest on the seat surface, an undercut, a flange element that engages with the undercut and has at least one threaded hole for a clamping bolt fixed in place on the fuel distributor, and a receiving element fixed in place at the valve, in which the flange element lies in a keyed connection, the threaded hole being positioned correctly with respect to the clamping bolt.

2. The device as recited in claim 1, wherein the flange element is snapped into place in the receiving element.

3. The device as recited in claim 2, wherein:

the flange element is a flat part, and the receiving element includes:

at least one bearing surface for the flange element, a plurality of detent hooks that overlap the flange element and have hook strips that axially project from the at least one bearing surface, and detents that radially project from the hook strips toward the inside.

4. The device as recited in claim 3, wherein the keyed connection exists between the hook strips and the flange element, wherein the keyed connection positions the flange element.

5. The device as recited in claim 3, wherein:

the flange element has mirror symmetry with a valve axis, and the flange element includes:

two diametrically disposed bearing surfaces as well as a central through hole for the pipe connection with a pressure surface which is formed in the through hole and corresponds to the undercut on the connection head, and two diametrically disposed threaded holes.

6. The device as recited in claim 3, wherein:

the flange element has a form of a fork having two fork arms that surround the pipe connection and engage with a pressure surface at the undercut of the connection head, a fork back of the fork interconnects the fork arms and includes a machined threaded hole, the receiving element has three bearing surfaces, for the fork back and one end of the two fork arms in each case, and the receiving element includes three detent hooks, of which one detent hook in each case overlaps the fork back and an end of the two fork arms.

7. The device as recited in claim 2, wherein the receiving element is formed by a plastic extrusion coat extruded onto the valve.

8. The device as recited in claim 2, wherein:

the seat surface has a conical form, and a head surface at the connection head has a spherical form.

9. The device as recited in claim 8, wherein the seat surface and the head surface are made of metal.

* * * * *